US007698840B2

(12) United States Patent
Rutkowski

(10) Patent No.: US 7,698,840 B2
(45) Date of Patent: Apr. 20, 2010

(54) FULL MOON CANVAS

(75) Inventor: Willow Rutkowski, 2449 Zena Lona NE., Albuquerque, NM (US) 87112

(73) Assignee: Willow Rutkowski, Albuquerque, NM (US)

( * ) Notice: Subject to any disclaimer, the term of this patent is extended or adjusted under 35 U.S.C. 154(b) by 984 days.

(21) Appl. No.: 10/908,196

(22) Filed: May 2, 2005

(65) Prior Publication Data

US 2006/0242866 A1 Nov. 2, 2006

(51) Int. Cl.
*D06C 3/08* (2006.01)
*D06C 3/00* (2006.01)

(52) U.S. Cl. ..... 38/102.91

(58) Field of Classification Search ..... 38/102, 38/102.91; 112/103, 117; 118/503; 135/901; 223/66, 120; 248/477.1, 477.2; 40/603
See application file for complete search history.

(56) References Cited

U.S. PATENT DOCUMENTS 1,917,935 A * 7/1933 Hahnel ..... 112/103
1,937,491 A * 11/1933 May ..... 112/117
2,044,422 A * 6/1936 Davidson ..... 40/538
2,549,878 A * 4/1951 Zeleznik ..... 38/102.1
2,728,156 A * 12/1955 Wandell, Jr. ..... 118/503
3,372,725 A * 3/1968 Voorhees ..... 137/585
3,886,990 A * 6/1975 Campione ..... 160/374.1
3,928,930 A * 12/1975 Attwood ..... 40/606.12
4,001,959 A * 1/1977 Grendahl ..... 40/720
4,412,398 A * 11/1983 Harmon ..... 43/1
4,995,178 A * 2/1991 Randolph ..... 38/102
5,027,989 A * 7/1991 Nevius ..... 223/120
5,067,547 A * 11/1991 Movrich ..... 160/327
5,088,678 A * 2/1992 Bitan ..... 248/460
5,327,694 A * 7/1994 Gamel et al. ..... 52/834
5,517,775 A * 5/1996 Kurtz ..... 38/102.91
5,649,379 A * 7/1997 Hoffman et al. ..... 40/617
5,662,412 A * 9/1997 Glendmyer ..... 362/351
5,732,494 A * 3/1998 Davey ..... 40/604
5,862,765 A * 1/1999 Grundl ..... 112/103
5,899,160 A * 5/1999 Hoag ..... 112/475.22
5,900,276 A * 5/1999 Sooklaris ..... 427/140
6,983,524 B2 * 1/2006 Eastwood ..... 29/428

* cited by examiner

*Primary Examiner*—Ismael Izaguirre

(57) ABSTRACT

Artists prefer to paint on canvas. Paintings previous to this invention, canvas paintings hung on flat walls because the have a flat back. This invention, a tubular canvas can not be place flat on a wall; it must either hang from the ceiling, set on flat pedestal so the viewer can walk around to see the painting in its entirety. With the Full Moon Canvas, the artist paints not on a flat canvas surface but a 360 degree round-tube-shaped, always curving, canvas of any height or circumference. Oil, acrylic or any art media can be applied. (To clarify only, visualize a drum where the sides are painted). It is constructed out of light weight wood. The flat top and bottom are exposed folded canvas from stretching the canvas. When the piece is finished, the flat ends are covered with smooth wood thus creating the frame.

5 Claims, 4 Drawing Sheets

NOTE:
CANVAS REMOVED
FOR CLARITY

FULL MOON CANVAS

BACKGROUND OF INVENTION

Ever since the canvas (also called cotton duck) and stretcher frames were introduced (approximately year 1520), the artist has preferred to paint on stretched canvas. Some of the world's greatest paintings are on canvas. We do not see, for example, the Mona Lisa, painted on wood or plastic. From Leonardo DeVince of the old world to Georgia O'Keefe of the modern world, from famous to not so famous artist all prefer the taut, slightly flexible, well stretched canvas as a painting surface. The painter's canvas has been various sizes of either squares or rectangles. More recently canvas has been stretched over circles or curvilinear frames. All of these types of stretched canvas have a flat back and are hung on wall for display.

Kurtz U.S. Pat. No. 5,517,775 invented a flexible, plastic, edging apparatus. The flexible plastic strip allows the canvas to rise off the wood while stretching so the wooden frame does not imprint a ghost line on the face of the canvas. The plastic ship is mainly for curvilinear shapes. Kurtz has invented a way to keep his invention in place with brackets. When canvas is stretched, using Kurtz invention no matter the size or shape (square, rectangular, or curvilinear) they will all have a flat back and when the painting is complete will be hung on a flat wall or set on a flat table. The canvas is flat.

In my invention, canvas is 360 degrees; canvas is always curving. There is a flat top and bottom, but paint is not applied there for that is where the staples are. This 360 degrees of stretch canvas has to be hung differently. They can not be hung against a flat wall because one could not see the work of art in its entirety and therefore looking awkward.

There has been an invention to help stretch sock material over a circular frame but this invention has nothing to do with stretched canvas. Hahnel U.S. Pat. No. 1,917,935 stretches sock material to a tubular shape with a metal adjustable frame device. And while some of the wording may sound similar to the Full Moon Canvas, the nature of a stretched sock and a work of art on a 360 degree canvas is not the same. Hahnel's invention is for sock fabric to be embroidered by an embroidery machine for the purpose of mass production of embroidered socks. His invention allows the sock to be embroidery on four sides. When finished the sock is removed, collapsed, and new sock material is put on his metal frame. Hahnel's invention is to decorate functional clothing for mass production, not to create the higher expression of art.

Beside mass production there is another major difference between Hahnel's invention and mine. Paintings are constructed out of canvas and wood making them light weight. The artist painting can be easily moved but to remove or separate a canvas from its frame is done only under very unusual circumstances, for example, to repair a damaged painting. The frame and painted canvas are considered one: unlike Hahnel's mass production invention.

This invention, the full moon canvas, is for a creative artist and their one of a kind work of art on canvas. Society enjoys art through galleries, home and the work place. Paintings are hung on the walls. They are put in places easy to view. The major difference of this invention with other oil or acrylic paintings is the Full Moon Canvas is a round or tubular canvas of any height and circumference. The painting or art is on 360 degrees of canvas. Therefore to view the whole painting (it can not be hung on a flat wall) it must either be hung from the ceiling far enough away from the wall so the viewer can walk around the piece, or placed on a surface so the viewer can walk around

FIELD OF INVENTION

The present invention relates to artist canvas stretched over a unique wooden tube-frame which changes the way paintings are viewed and how the artist paints on canvas. The canvas is always turning to make up 360 degrees of stretched canvas over the frame. Since the shape of the canvas is tube shaped the viewing of the art is accomplished by walking around the work.

PARTS LIST

11 PINE WOOD BASE
22 PINE WOOD VERTICAL SUPPORTS
18 PINE WOOD REINFORCEMENTS BLOCK
33 WOOD SCREWS
36 COVER ARTIST CANVAS

BRIEF DESCRIPTION OF THE FIGURES

For a better understanding of the present invention, reference is made to the following detailed description in conjunction with accompanying drawings.

DETAILED DESCRIPTION OF THE FIGURES

Figure 1:
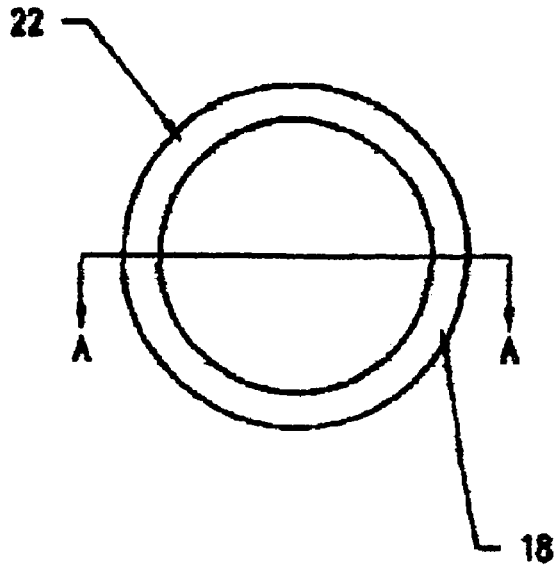
FIG. 1. Is a perspective view of the invention.

FIG. 1. Is comprised of two parts whose dimension A is variable. 18 is a wood reinforcement block. 22 corresponds to a vertical support made from pine wood.

Figure 2:
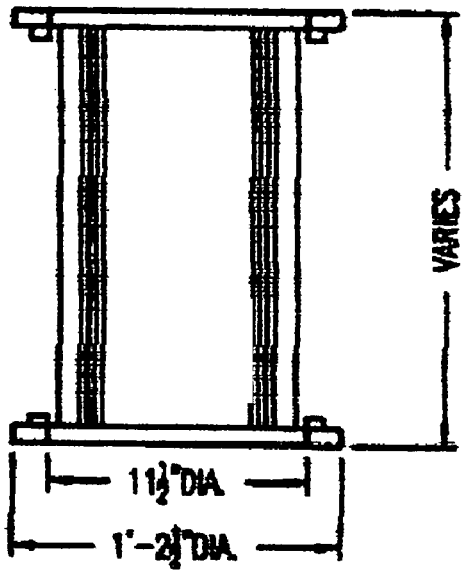
FIG. 2. Is a side view in elevation of the supporting structure for FIG. 1

FIG. 2. Has the canvas removed for clarity. The elevation of this figure is variable and its diameter corresponds to two variable dimensions, an interior of the frame whose size may vary between 1-1½ feet, and an outer frame whose size may vary between 1-2½ feet.

Figure 3:
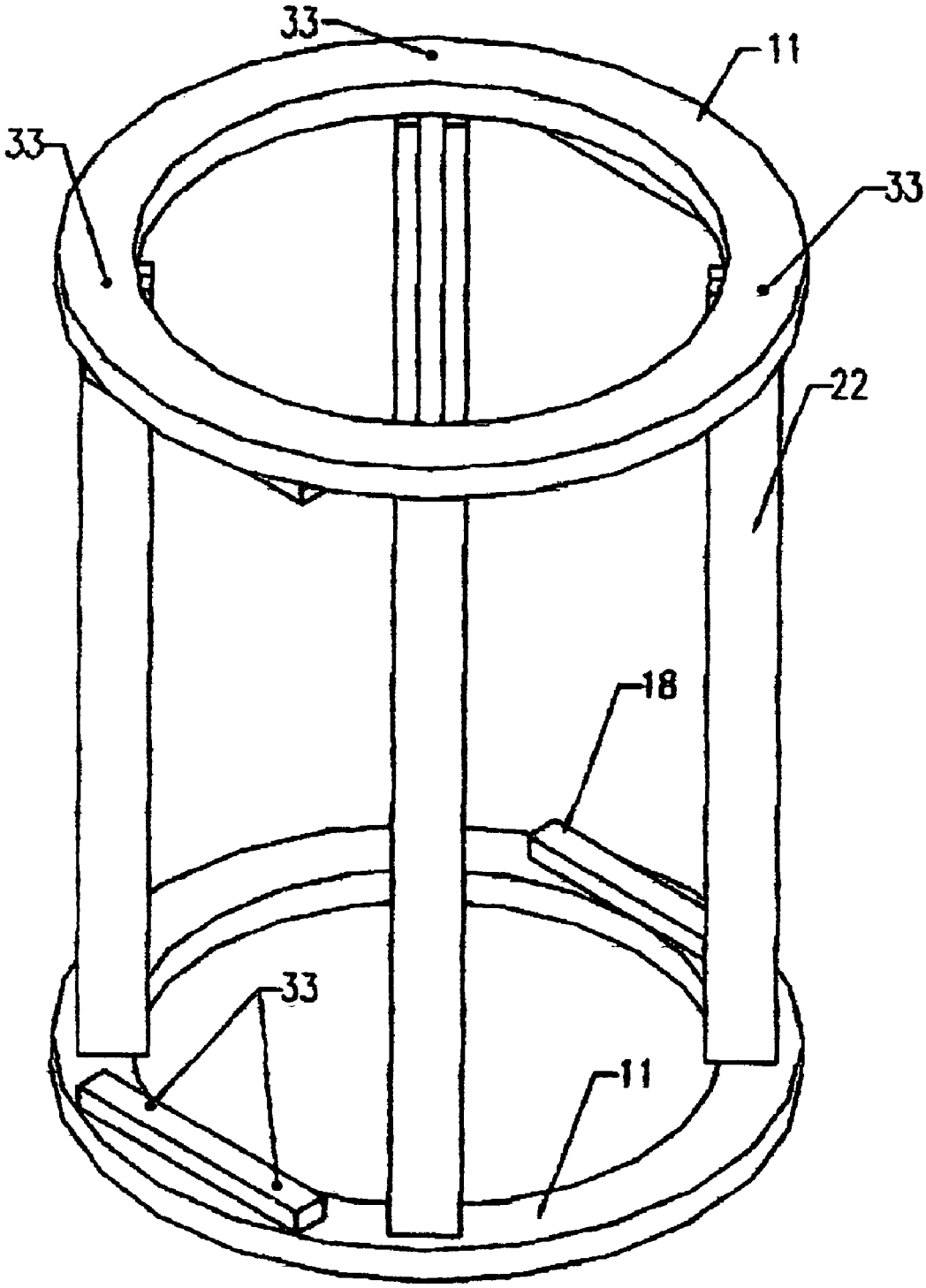
FIG. 3. Is a three-quarter view of the support structure in FIG. 2

FIG. 3. Is a constructed support for the invention. 11, the pine wood base is connected to 18 pine wood reinforcement blocks with 33 wood screws. 11 is connected to 22 the vertical supports with 33 wood screws and the 18 pine wood reinforcement blocks at three separate places in 11. Each point of contact is reinforced with (2) 33 wood screws.

Figure 4:
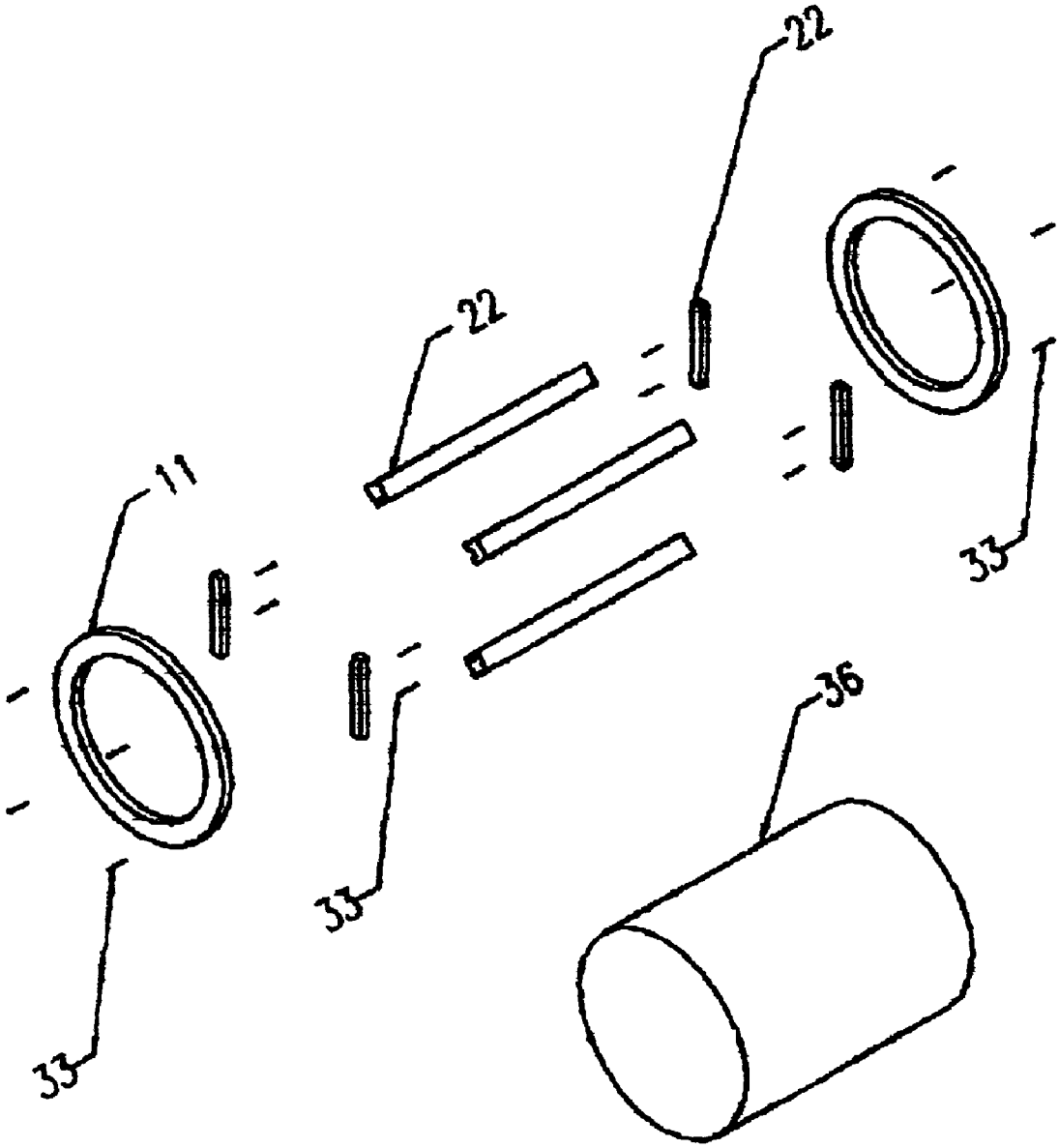
FIG. 4. Is an exploded diagram of the invention illustrating its component parts.

FIG. 4. Is an exploded diagram of the invention. 11 is connected to 22 with 33 at at three places on 11. The points of connection are repeated on both pieces of 11, with separate pieces of 18, two to each side of the tubular dimensions. 36 is then stretched around the construction. Emphasis of the design is on the light weight of the components, which allow it to be easily transported and adjusted while its surface is prepared.

Figure 5:
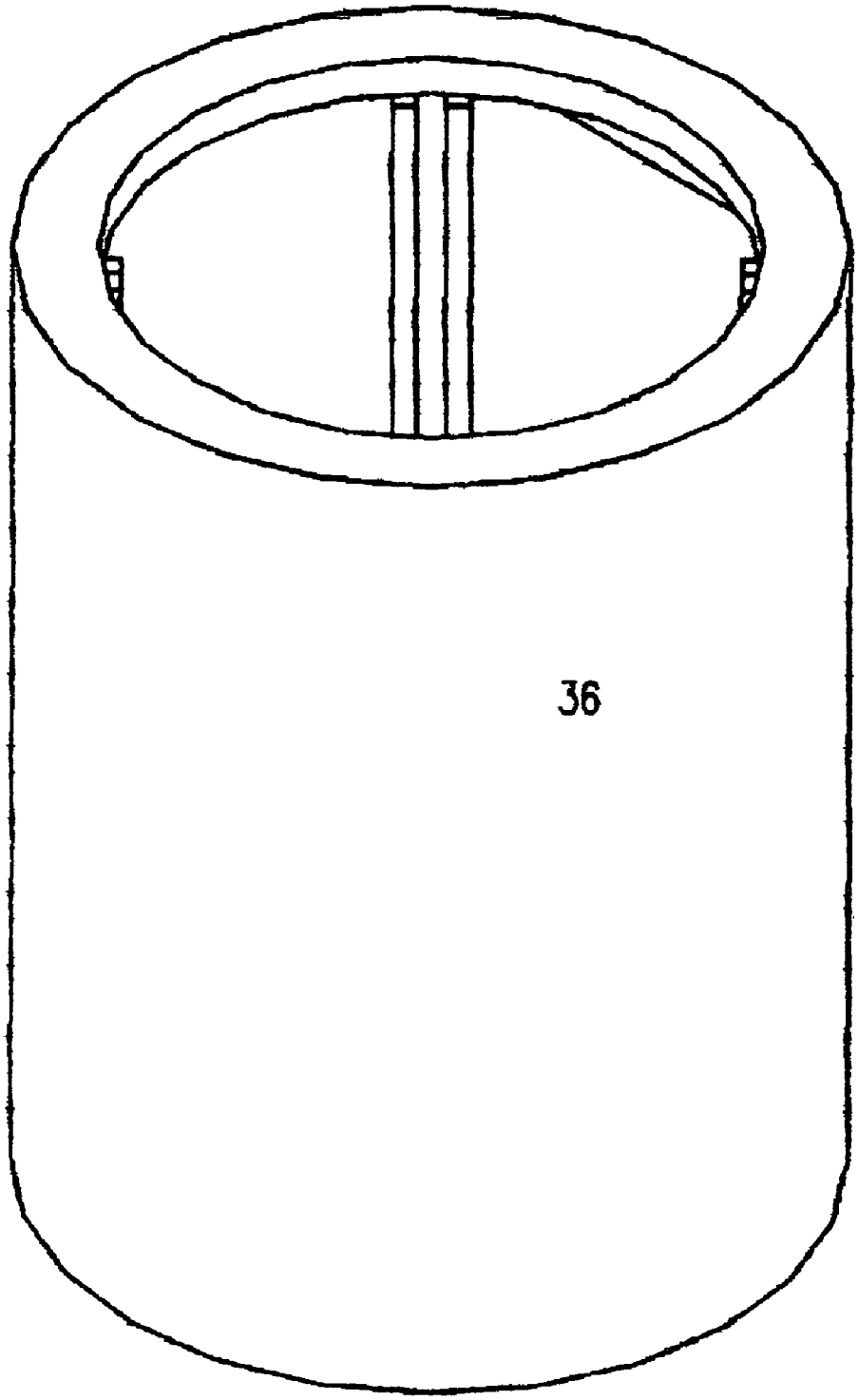
FIG. 5. Is a three-quarter view of the support structure of the invention as it would appear with a piece of canvas stretched around it.

FIG. 5. 36 has been stretched around the support structure, employing its dimensions and diameter as an armature for a 360 degree surface. Artists prefer a continuos surface upon which to employ their materials, and this constructed device provides a taught surface which can be worked and later viewed from many angles.

What is claimed is:

1. An artist canvas comprising:

a frame of any height and circumference; comprising:

a flat wooden ring at the top and one at the bottom: and three or more wooden legs for connection the rings and forming a tubular frame;

and wooden stops provided on the rings for locating the legs thereon;

canvas material curving 360 degrees attached and covering the height of the frame for allowing a new way to view and enjoy paintings as art; and wherein paint or other media is applied to the canvas material; and providing wooden cover discs for covering the top and bottom unpainted portions of the frame.

2. The art canvas of claim 1, comprising:

the wood stops being glued to the rings for keeping the legs in place while attaching the legs; and means for hanging the art canvas from a ceiling or placing on a pedestal or for fixing on a rotation device that would turn the painting in its entirely.

3. A method for forming as artist canvas, comprising the steps of: forming a frame of any height and circumference; by cutting two identical flat rings out of wood for forming the flat top and bottom pieces of the frame; and providing three or more wooden legs for providing a height to the frame; and attaching the legs to the rings for forming the flat top and bottom pieces of the frame; and proving three or more wooden legs for providing a height to the frame; and attaching the legs to the rings for forming the frame; and cutting, stretching and attaching canvas material to the frame for covering the height of the frame with the canvas material curving 360 degrees; and applying paint or other media to complete the work of art; and covering the top and bottom of the frame with wooden discs.

4. The method of claim 3, comprising:

gluing wood stops to at least one disc so that the legs will stay in place while being attached; and screwing the legs to the top and bottom discs.

5. The art canvas of claim 1, comprising;

a piece of canvas material is stretched over the wooden frame for providing artwork to art canvas; and glue is provided to the edge of the canvas for attaching the canvas to the frame.

* * * * *